US011781729B2

(12) United States Patent
Ding

(10) Patent No.: US 11,781,729 B2
(45) Date of Patent: Oct. 10, 2023

(54) LAMP BODY AND BULB LAMP

(71) Applicants: SUZHOU OPPLE LIGHTING CO., LTD., Suzhou (CN); OPPLE LIGHTING CO., LTD., Shanghai (CN)

(72) Inventor: Junguang Ding, Suzhou (CN)

(73) Assignees: Suzhou Opple Lighting Co., Ltd., Suzhou (CN); Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/562,989

(22) Filed: Dec. 27, 2021

(65) Prior Publication Data

US 2022/0120407 A1 Apr. 21, 2022

Related U.S. Application Data

(63) Continuation of application No. PCT/CN2020/111567, filed on Aug. 27, 2020.

(30) Foreign Application Priority Data

Sep. 17, 2019 (CN) ..... 201921546846.X

(51) Int. Cl.
*F21V 1/12* (2006.01)
*F21V 19/00* (2006.01)

(52) U.S. Cl.
CPC ..... *F21V 1/12* (2013.01); *F21V 19/003* (2013.01)

(58) Field of Classification Search
CPC ..... F21V 1/12; F21V 19/003; F21V 3/02
See application file for complete search history.

(56) References Cited

U.S. PATENT DOCUMENTS 10,082,269 B2 * 9/2018 Edmond ..... F21V 23/006
10,605,412 B1 * 3/2020 Garber ..... F21K 9/232
(Continued)

FOREIGN PATENT DOCUMENTS

CN 203404744 U 1/2014
CN 211344826 U 8/2020

OTHER PUBLICATIONS

CN_203404744_U, machine translation Jan. 2014 (Year: 2014).*
(Continued)

*Primary Examiner* — Tracie Y Green
(74) *Attorney, Agent, or Firm* — Arch & Lake LLP

(57) ABSTRACT

The present application discloses a lamp body and a bulb lamp, the lamp body includes a lampshade and a light source assembly, which is integrated on the lampshade. The light source assembly is integrated on the lampshade, a distance between the light source assembly and the external environment is shorten, and the thermal performance is improved. The lampshade includes a mounting window, and the light source assembly is mounted in the mounting window, so that heat of the light source assembly can be directly dissipated to the external environment. The light source assembly includes a light source a transparent light source substrate, a surface of the light source substrate facing an inner cavity of the lampshade is a mounting surface, and the light source is mounted on the mounting surface. The bulb lamp includes a lamp holder and the abovementioned lamp body, the lampshade is connected with the lamp holder.

13 Claims, 5 Drawing Sheets

(56) References Cited

U.S. PATENT DOCUMENTS

| | | | | |
|---|---|---|---|---|
| 2004/0048719 | A1* | 3/2004 | Cheng | B62J 50/22<br>482/902 |
| 2010/0327745 | A1* | 12/2010 | Dassanayake | F21K 9/64<br>315/35 |
| 2021/0270454 | A1* | 9/2021 | Conrad | F21V 29/777 |

OTHER PUBLICATIONS

International Search Report of PCT Application No. PCT/CN2020/111567 dated Nov. 24, 2020 with English translation, (4p).

* cited by examiner

LAMP BODY AND BULB LAMP

CROSS-REFERENCE TO RELATED APPLICATIONS

This application is based upon and claims the priority of PCT patent application No. PCT/CN2020/111567 filed on Aug. 27, 2020 which claims priority to the Chinese patent application No. 201921546846.X filed on Sep. 17, 2019, the entire contents of which are hereby incorporated by reference herein for all purposes.

TECHNICAL FIELD

The present disclosure relates to a lamp body and a bulb lamp.

BACKGROUND

A light-emitting diode (LED) filament lamp includes a light source assembly, a lampshade and a lamp holder; the light source assembly is arranged in the lampshade; the lampshade is connected with the lamp holder, and the light source assembly is electrically connected with an electrical element in the lamp holder; and the electrical element in the lamp holder is electrically connected with an external power supply.

SUMMARY

The present disclosure provides a lamp body and a bulb lamp with good heat dissipation effect.

The present disclosure provides a lamp body. The lamp body may include a lampshade and a light source assembly, and the light source assembly may be integrated on the lampshade.

The present disclosure also provides a bulb lamp. The bulb lamp may include a lamp holder and a lamp body. The lamp body may include a lampshade and a light source assembly, and the light source assembly may be integrated on the lampshade. The lampshade may be connected with the lamp holder, a driving power supply may be provided in the lamp holder, and the light source assembly is electrically connected with the driving power supply.

It is to be understood that both the foregoing general description and the following detailed description are exemplary and explanatory only and are not restrictive of the present disclosure.

BRIEF DESCRIPTION OF THE DRAWINGS

The accompanying drawings described here are used for further understanding of the present disclosure and constitute one part of the present disclosure. Schematic examples of the present disclosure and the description thereof are used to explain the present disclosure, and do not constitute an improper limitation to the present disclosure.

DETAILED DESCRIPTION

Figure 1:
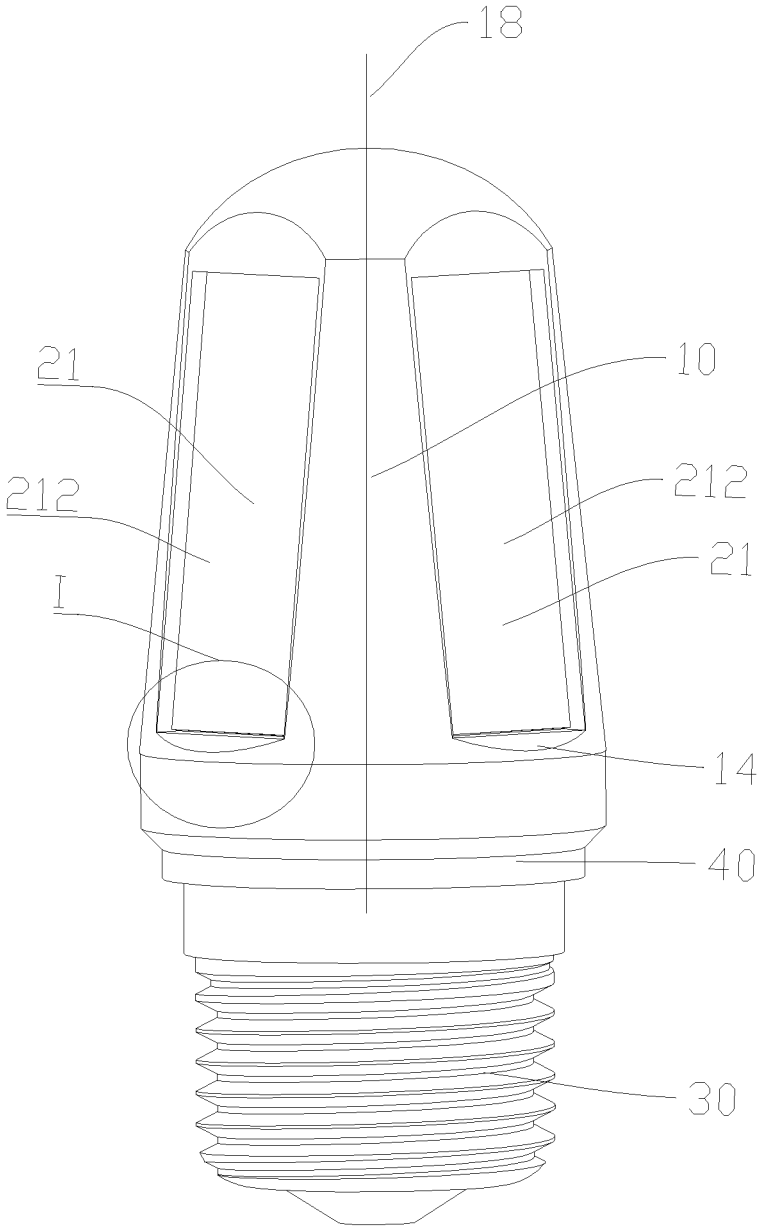
FIG. 1 is a stereoscopic diagram of a bulb lamp according to an example of the present disclosure.

To make the purpose, technical solutions and advantages of the present disclosure clearer, the technical solutions of the present disclosure are described clearly and completely below in combination with examples of the present disclosure and corresponding accompanying drawings. Apparently, the described examples are only some examples of the present disclosure, but not all examples. All other examples obtained by a person of ordinary skill in the art based on the examples of the present disclosure without creative efforts shall fall within the protection scope of the present disclosure.

Description of names and reference numerals of components in the drawings are provided as follows:

Lampshade 10, mounting window 11, limiting surface 12, pressing surface 13, guiding slope 14, slot 15, inner cavity 16, mounting end 17, axis 18, light source assembly 20, light source substrate 21, mounting surface 211, light emitting surface 212, light source 22, electrical element 23, lamp holder 30, and insulating element 40.

The light source assembly of a LED filament lamp may be spaced to the lampshade, heat of the light source assembly needs to be first transferred to the lampshade, and then the heat is dissipated to the external environment through the lampshade; and the distance between the light source assembly and the external environment is relatively large, so that a heat dissipation effect is poor, the power of the LED filament lamp is limited, and the power of the LED filament lamp is relatively small. The LED filament lamp with high power may be short in service life.

Figure 3:
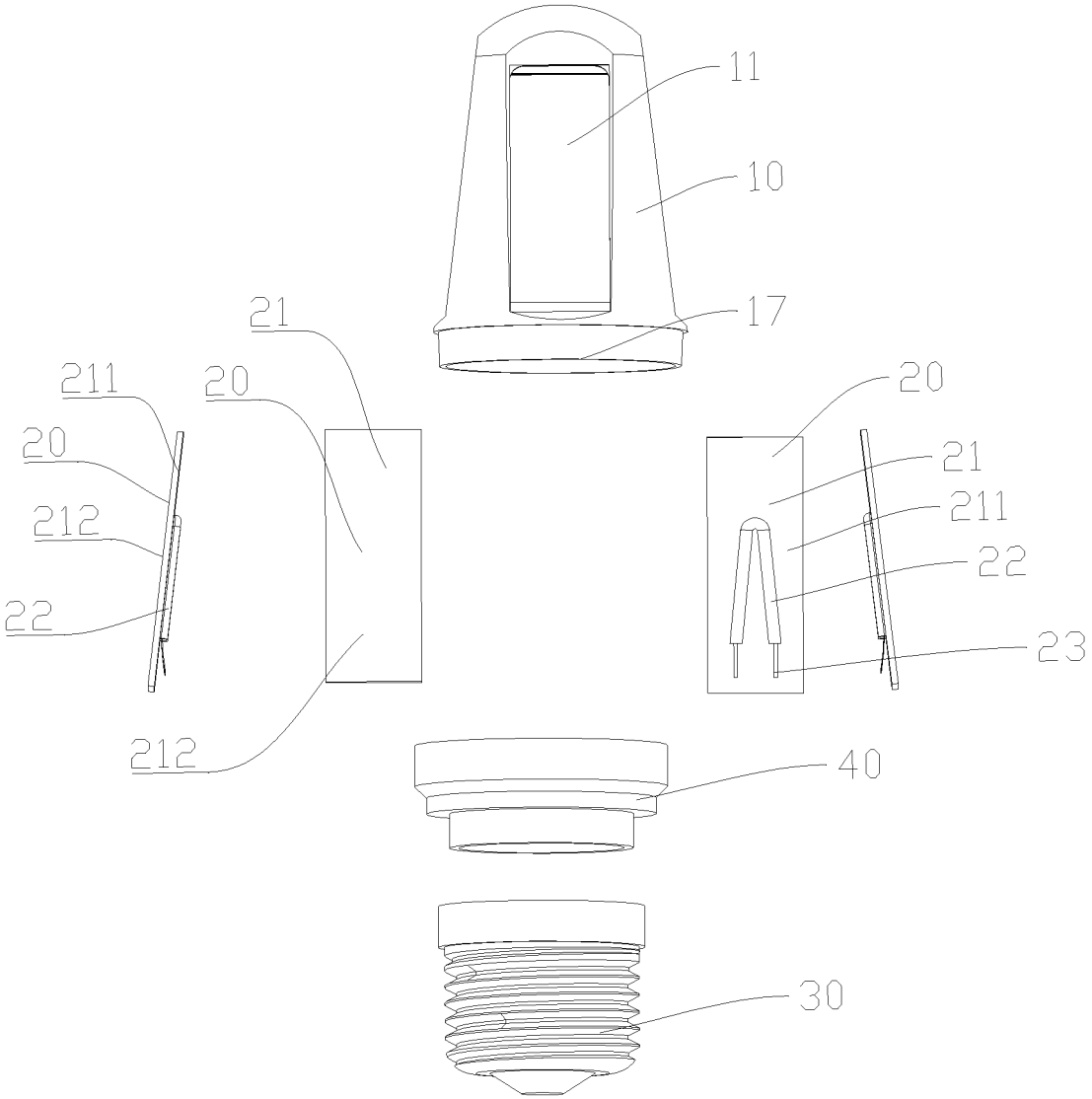
FIG. 3 is an exploded view of a bulb lamp according to an example of the present disclosure.

As illustrated by FIG. 1, the present example discloses a bulb lamp. The bulb lamp includes a lamp holder 30 and a lamp body, the lamp body includes a lampshade 10 and a light source assembly 20, and the lampshade 10 is connected with the lamp holder 30. Specifically, referring to FIG. 1 and FIG. 3, the lampshade 10 has a mounting end 17, the mounting end 17 is an open end, and the lamp holder 30 is connected with the mounting end 17. An insulating element 40 is arranged between the lamp holder 30 and the mounting end 17. Two ends of the insulating element 40 are open ends, the mounting end 17 is inserted into the insulating element 40 from one open end of the insulating element 40, and the other end of the insulating element 40 is connected with the lamp holder 30. A driving power supply is provided in the lamp holder 30. The light source assembly 20 includes an electrical element 23, the electrical element 23 passes through the mounting end 17 to be electrically connected with the driving power supply, and the driving power supply is electrically connected with an external power supply through an electric wire so as to supply power to the whole bulb lamp.

The light source assembly 20 is integrated on the lampshade 10. In the present example, the light source assembly 20 is integrated on the lampshade 10, so that a distance between the light source assembly 20 and the external environment is reduced, and the heat dissipation efficiency is improved. Specifically, the light source assembly 20 includes a light source substrate 21 and a light source 22 mounted on the light source substrate 21, and the light source substrate 21 is integrated on the lampshade 10.

Preferably, a method for integrating the light source assembly 20 on the lampshade 10 is provided as follows: the lampshade 10 has a mounting window 11, and the light source substrate 21 is mounted in the mounting window 11, so that the light source assembly 20 can dissipate the heat directly to the external environment, the heat dissipation efficiency is high, and it is not needed to transfer the heat to the lampshade 10 first and then dissipate the heat to the external environment through the lampshade 10.

The number of the mounting window 11 may be 1, 2, 3, 4, 5, etc. The mounting windows 11 are arranged at intervals along a circumferential direction of the lampshade 10. One light source substrate 21 is provided in each mounting window 11.

Figure 4:
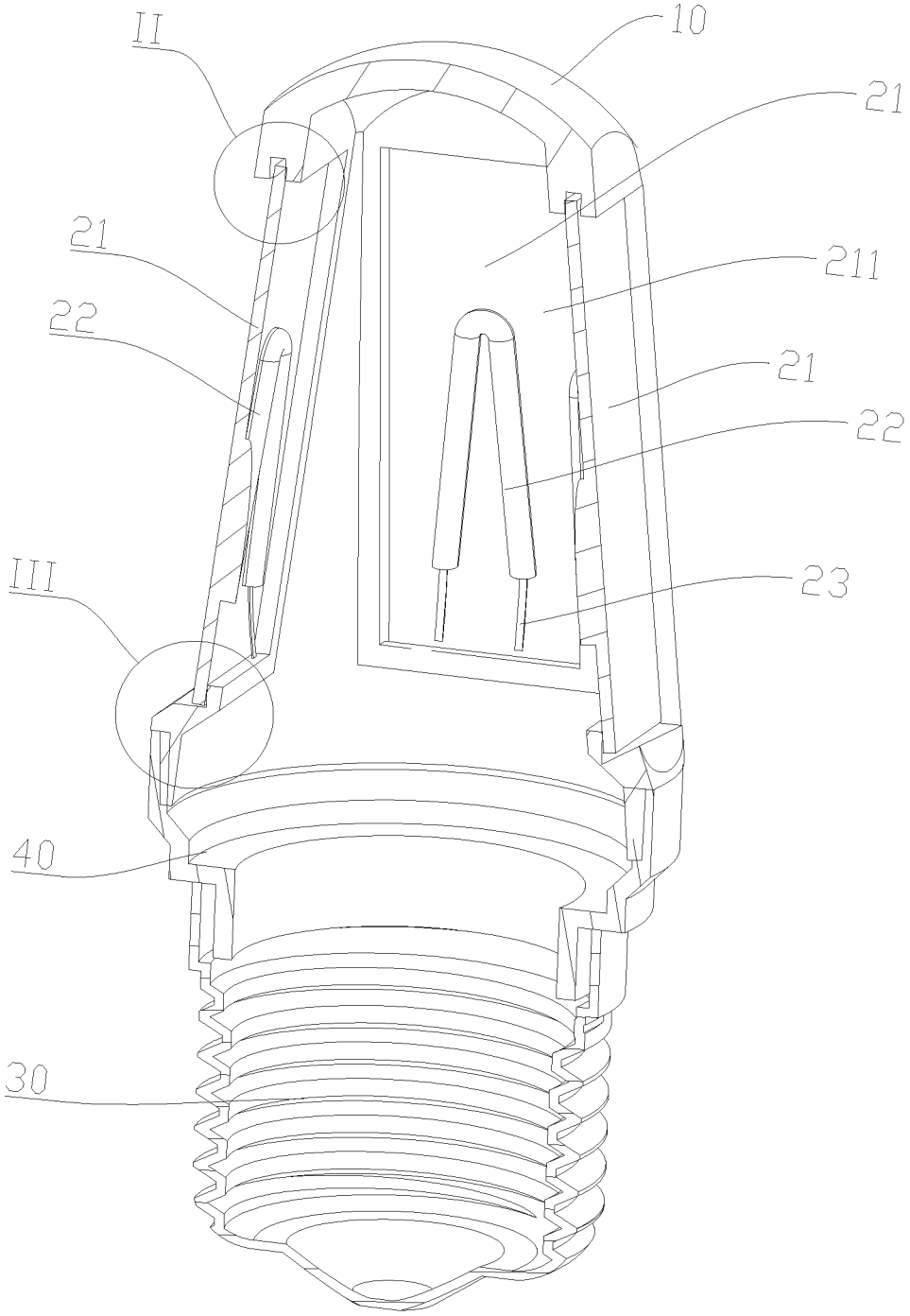
FIG. 4 is a sectional view of a bulb lamp according to an example of the present disclosure.

The lampshade 10 is made of a transparent material, and a part of light of the light source 22 can be irradiated to the external environment through the lampshade 10. The light source substrate 21 is a transparent light source substrate, for example, the light source substrate 21 may be a glass light source substrate. As illustrated by FIG. 4, the surface of the light source substrate 21 facing an inner cavity 16 of the lampshade 10 is a mounting surface 211, an outer surface of the light source substrate 21 is a light emitting surface 212, the light source 22 is mounted on the mounting surface 211, and the light emitted from the light source 22 can be irradiated to the external environment through the light emitting surface 212 of the light source substrate 21. The light source substrate 21 not only can protect the light source 22, but also can improve the light emitting efficiency of the bulb lamp. In other examples, the light source substrate 21 may also be light-proof, and the light of the light source 22 can be irradiated to the external environment only through the lampshade 10.

The light source 22 is attached to the mounting surface 211, and the heat of the light source 22 is transferred directly to the light source substrate 21, so that the heat transferring efficiency is high. For example, the light source 22 may be a lamp filament, and the lamp filament is easy to attach to the mounting surface 211.

The mounting window 11 may be a rectangular window, and the mounting window 11 has two side walls, one top wall and one bottom wall, a distance between the bottom wall and the mounting end 17 is shorter than a distance between the top wall and the mounting end 17.

Figure 5:
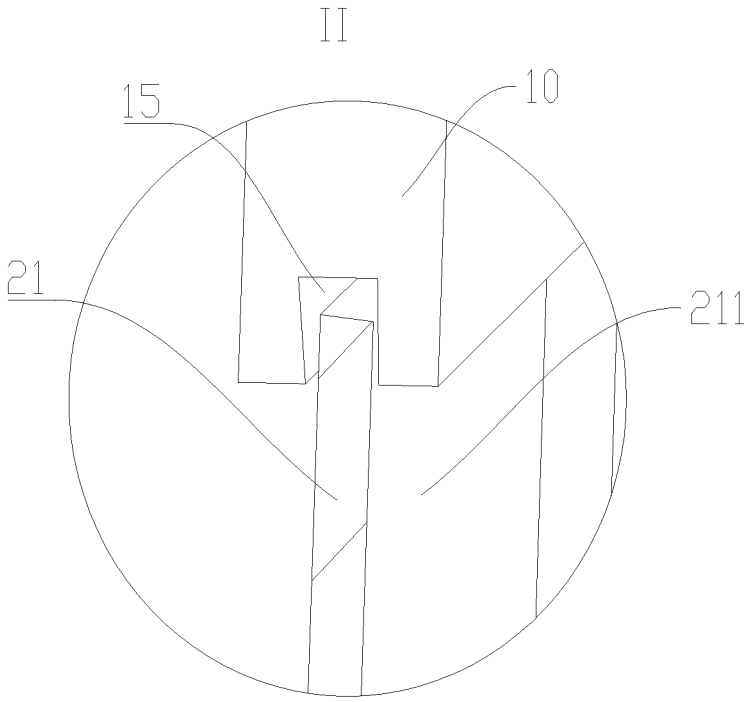
FIG. 5 is a partial enlarged view of a position II in FIG. 4.
Figure 6:
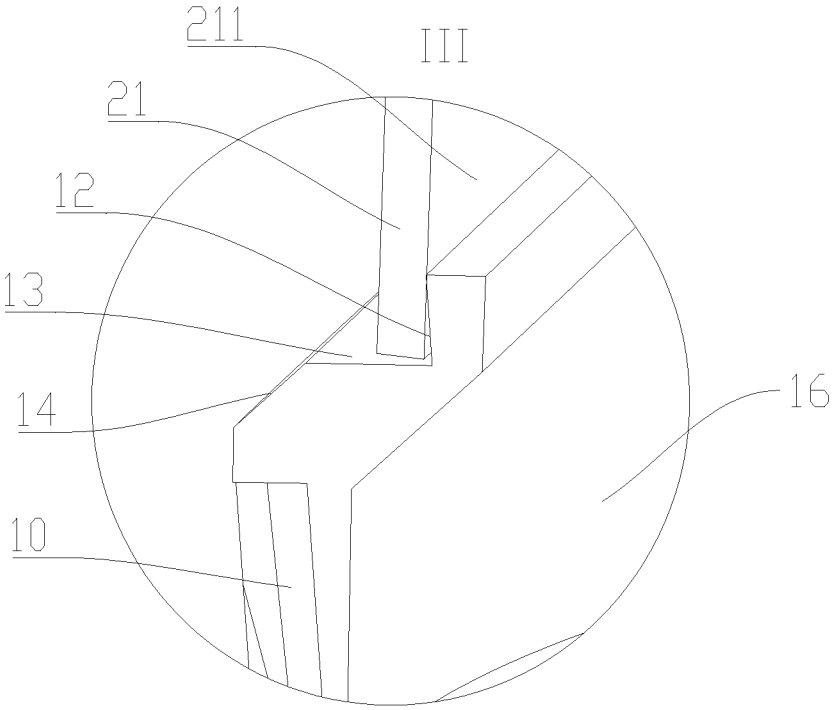
FIG. 6 is a partial enlarged view of a position III in FIG. 4.

The light source substrate 21 is embedded on the lampshade 10. Specifically, as illustrated by FIG. 6, the bottom wall forms a pressing surface 13, and the bottom end surface of the light source substrate 21 presses the pressing surface 13. The lampshade 10 includes a limiting surface 12 connected with the pressing surface 13, the limiting surface 12 is located at an inner side of the pressing surface 13 and forms an angle with the pressing surface 13, and the limiting surface 12 is in limiting fit with the mounting surface 211, so that light source substrate 21 can be prevented from moving towards the inner cavity 16. The limiting surface 12 may be perpendicular to the pressing surface 13, and may also form an angle greater than 90° or less than 90° with the pressing surface 13. The specific angle may be determined according to an angle of the mounting surface 211 with respect to the pressing surface 13. As illustrated by FIG. 5, the top wall of the mounting window 11 has a slot 15, and the top end of the light source substrate 21 is inserted into the slot 15.

Figure 2:
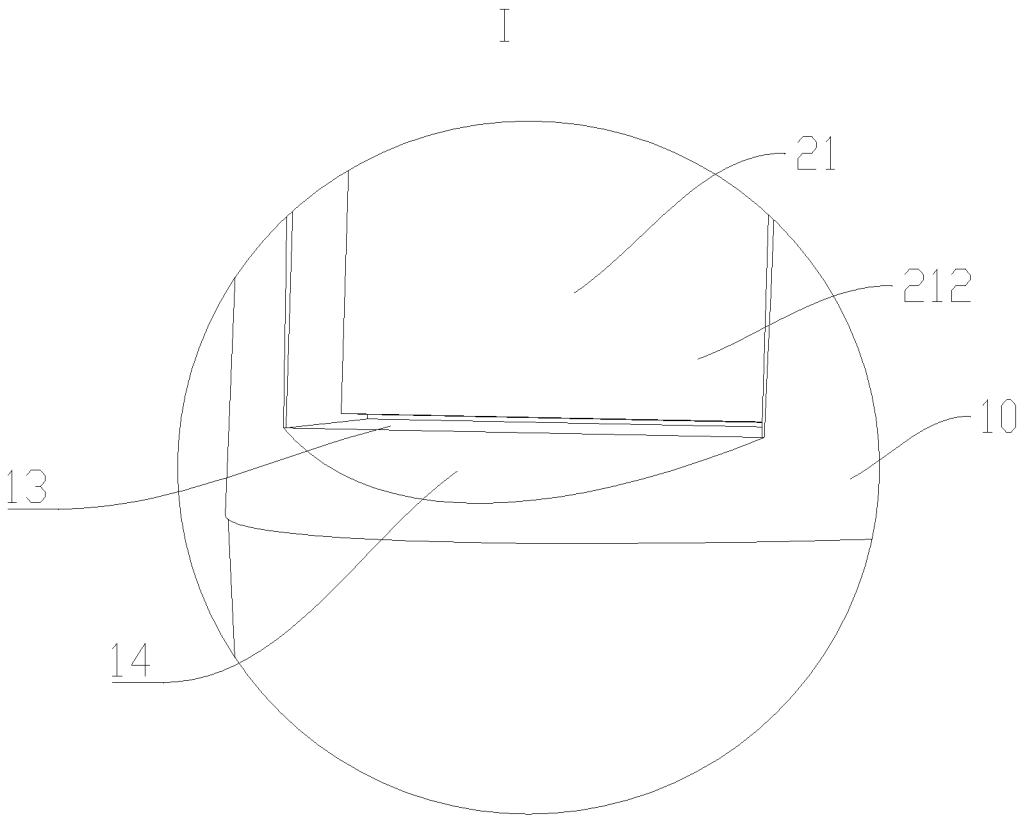
FIG. 2 is a partial enlarged view of a position I in FIG. 1.

As illustrated by FIG. 2 and FIG. 6, the lampshade 10 includes a guiding slope 14 connected with the pressing surface 13, and the guiding slope 14 is located at the outer side of the pressing surface 13. One end of the guiding slope 14 is connected with the pressing surface 13, and the other end of the guiding slope 14 faces outward in the radial direction and extends towards the mounting end 17. The pressing surface 13 is a flat surface, and an angle between the guiding slope 14 and the pressing surface 13 is greater than 90° and less than 180°.

As illustrated by FIG. 4, the diameter of the lampshade 10 in a direction away from the mounting end 17 is reduced gradually, which makes the distance between the slot 15 and an axis 18 of the lampshade 10 shorter than the distance between the pressing surface 13 and the axis 18 of the lampshade 10, so that when the bottom end of the light source substrate 21 slides towards the pressing surface 13 along the guiding slope 14, the top end of the light source substrate 21 can be inserted into the slot 15 easily, and the light source substrate 21 is convenient to mount.

The surfaces, except for the mounting surface 211, light-emitting surface 212, top end surface and bottom end surface, of the light source substrate 21 are side surfaces, the top end surface of the light source substrate 21 is an end surface of an end inserted into the slot 15, and the bottom end surface of the light source substrate 21 is a surface abutting the pressing surface 13. Two side surfaces of the light source substrate 21 are spaced to the two side walls of the mounting window 11.

Because the light source substrate 21 of the present example is mounted in the mounting window 11 of the lampshade 10, the light source substrate 21 and the lampshade 10 collectively form a lamp cavity, the outer surface of the light source substrate 21 and the outer surface of the lampshade 10 collectively form an outer surface of the lamp body, and it may also be considered that the outer surface of the light source substrate 21 is coplanar with the outer surface of the lampshade 10.

The light source substrate 21 of the present example is very convenient to mount in the mounting window 11, and it is not needed to arrange a connecting member, so that the bulb lamp of the present example has fewer components, and the structure is simple.

In other examples, the lampshade 10 may also be in other shapes, for example, the positions of the slot 15 and pressing surface 13 may be exchanged, and then the diameter of the lampshade 10 in a direction away from the mounting end 17 is increased gradually. The guiding slope 14 is still connected with the pressing surface 13, the guiding slope 14 is convenient for the top end of the light source substrate 21 to enter the pressing surface 13, and while the top end of the light source substrate 21 enters the pressing surface 13, the bottom end of the light source substrate 21 is inserted into the slot 15.

In other examples, the light source substrate 21 may be mounted in the mounting window 11 in other methods, for example, the light source substrate 21 may be pasted onto the outer surface or inner surface of the lampshade 10 and block the mounting window 11. The light source substrate 21 may also be mounted in the mounting window 11 through the connecting member.

The present disclosure provides a lamp body and a bulb lamp with good heat dissipation effect.

A lamp body, including a lampshade and a light source assembly, the light source assembly is integrated on the lampshade.

Preferably, in the abovementioned lamp body, the lampshade includes a mounting window, and the light source assembly is mounted in the mounting window.

Preferably, in the abovementioned lamp body, the light source assembly includes a light source and a light source substrate, which is transparent; a surface of the light source substrate facing an inner cavity of the lampshade is a mounting surface, and the light source is mounted on the mounting surface.

Preferably, in the abovementioned lamp body, the light source substrate is embedded on the lampshade.

Preferably, in the abovementioned lamp body, at least two light source substrates are provided, and the at least two light source substrates are arranged on the lampshade at intervals.

Preferably, in the abovementioned lamp body, the light source is a filament structure, and the light source is attached to the mounting surface.

Preferably, in the abovementioned lamp body, the light source assembly includes a light source substrate and a light source mounted on the light source substrate, an inner wall of the mounting window forms a pressing surface, and an end surface of the light source substrate presses the pressing surface.

Preferably, in the abovementioned lamp body, the lampshade includes a limiting surface connected with the pressing surface, and the limiting surface is in limiting fit with the mounting surface.

Preferably, in the abovementioned lamp body, the lampshade includes a guiding slope, one end of the guiding slope is connected with the pressing surface, and the other end of the guiding slope inclines outward in a radial direction.

Preferably, in the abovementioned lamp body, another inner wall of the mounting window includes a slot, and the other end of the light source substrate is inserted into the slot.

Preferably, in the abovementioned lamp body, a distance between the slot and an axis of the lampshade is shorter than a distance between the pressing surface and the axis.

A bulb lamp, including a lamp holder and the abovementioned lamp body, the lampshade is connected with the lamp holder, a driving power supply is provided in the lamp holder, and the light source assembly is electrically connected with the driving power supply.

Preferably, in the abovementioned bulb lamp, an insulating element is arranged between the lampshade and the lamp holder.

Compared with the existing art, the beneficial effects of the present disclosure are provided as follows: the light source assembly is integrated on the lampshade, a distance between the light source assembly and the external environment is shortened, and the heat dissipation effect is improved.

The above description is only examples of the present disclosure and is not used to limit the present disclosure. For those skilled in the art, various changes and variations of the present disclosure can be made. Any modifications, equivalent substitution and improvements made within the spirit and principle of the present disclosure shall fall within the scope of the present disclosure.

What is claimed is:

1. A lamp body, comprising a lampshade and a light source assembly, wherein the light source assembly is integrated on the lampshade; the lampshade is transparent and truncated cone shape; the lampshade comprises a rectangular mounting window.

2. The lamp body according to claim 1, wherein the light source assembly is mounted in the mounting window.

3. The lamp body according to claim 2, wherein the light source assembly comprises a light source and a light source substrate, which is transparent; a surface of the light source substrate facing an inner cavity of the lampshade is a mounting surface, and the light source is mounted on the mounting surface.

4. The lamp body according to claim 3, wherein the light source substrate is embedded on the lampshade.

5. The lamp body according to claim 3, wherein at least two light source substrates are provided, and the at least two light source substrates are arranged on the lampshade at intervals.

6. The lamp body according to claim 3, wherein the light source is a filament structure, and the light source is attached to the mounting surface.

7. The lamp body according to claim 2, wherein the light source assembly comprises a light source substrate and a light source mounted on the light source substrate, an inner wall of the mounting window forms a pressing surface and an end surface of the light source substrate presses the pressing surface.

8. The lamp body according to claim 7, wherein the lampshade comprises a limiting surface connected with the pressing surface, and the limiting surface is in limiting fit with the mounting surface.

9. The lamp body according to claim 7, wherein the lampshade comprises a guiding slope, one end of the guiding slope is connected with the pressing surface, the other end of the guiding slope inclines outward in a radial direction, and the angle between the guiding slope and the pressing surface is greater than 90 degrees and less than 180 degrees.

10. The lamp body according to claim 7, wherein another inner wall of the mounting window comprises a slot, and an end of the light source substrate is inserted into the slot.

11. The lamp body according to claim 10, wherein a distance between the slot and an axis of the lampshade is shorter than a distance between the pressing surface and the axis.

12. A bulb lamp, comprising a lamp holder and a lamp body, wherein:

the lamp body comprises a lampshade and a light source assembly, and the light source assembly is integrated on the lampshade, wherein the lampshade is transparent and truncated cone shape; the lampshade comprises a rectangular mounting window; and the lampshade is connected with the lamp holder, a driving power supply is provided in the lamp holder, and the light source assembly is electrically connected with the driving power supply.

13. The bulb lamp according to claim 12, wherein an insulating element is arranged between the lampshade and the lamp holder.

* * * * *